United States Patent [19]

Diener et al.

[11] 4,207,094

[45] Jun. 10, 1980

[54] METHOD FOR PREHEATING THE OXYGEN IN AN OXYGEN STEEL MAKING PROCESS

[75] Inventors: Arnulf Diener; Fritz Meininghaus; Günter Oehmen; Robert Schrott, all of Dortmund, Fed. Rep. of Germany

[73] Assignee: Hoesch Werke Aktiengesellschaft, Dortmund, Fed. Rep. of Germany

[21] Appl. No.: 888,004

[22] Filed: Mar. 20, 1978

[30] Foreign Application Priority Data

Mar. 25, 1977 [DE] Fed. Rep. of Germany ..... 2713171

[51] Int. Cl.[2] ..... C21C 5/30

[52] U.S. Cl. ..... 75/60

[58] Field of Search ..... 75/60

[56] References Cited

U.S. PATENT DOCUMENTS 16,082 11/1856 Bessemer ..... 75/60

3,357,820 12/1967 Rasworschegg ..... 75/60

3,799,763 3/1974 Dortenzo ..... 75/60

*Primary Examiner*—P. D. Rosenberg

*Attorney, Agent, or Firm*—Max Fogiel

[57] ABSTRACT

A method for preheating the oxygen used in converters. Steam which is already available in the usual steel manufacturing plant, is used to preheat the oxygen. The steam may be generated from waste gas produced in an converter process. A heat exchanger which may be placed into an oxygen supply line, feeds into a line of the blast lance. This heat exchanger may be placed between the feed line to the blast lance and shut off and control devices in the oxygen supply line. A connector in the oxygen supply line may be located between the heat exchanger and the feed line to the blast lance, and may be heat-insulated.

2 Claims, 1 Drawing Figure

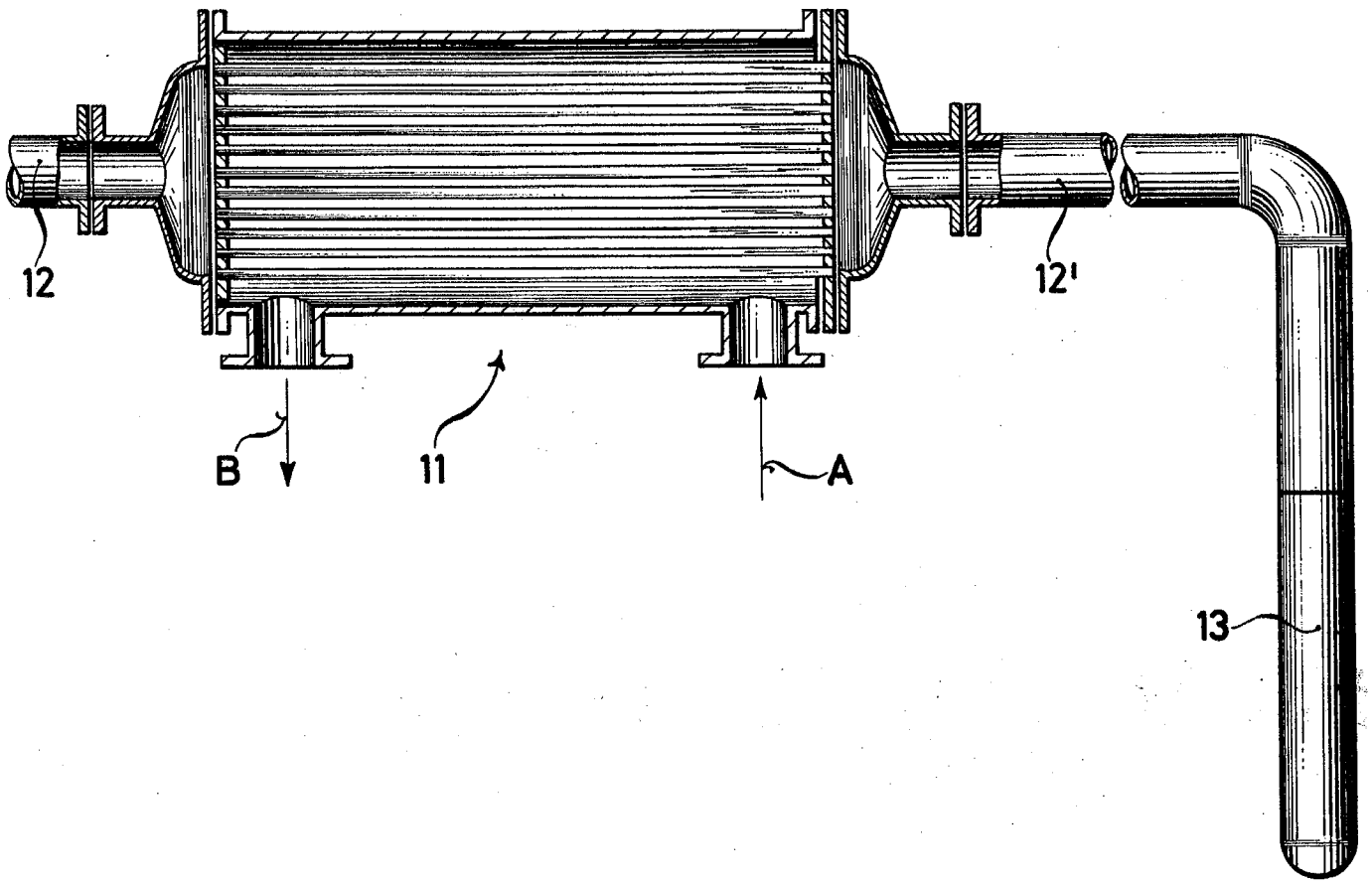
12
B
11
A
12'
13

METHOD FOR PREHEATING THE OXYGEN IN AN OXYGEN STEEL MAKING PROCESS

BACKGROUND OF THE INVENTION

The present invention relates to a method for preheating the oxygen in oxygen steel making processes, especially in the so called LD-Process.

In oxygen steel making processes, the entire energy required for the metallurgical reactions is usually supplied exclusively by the heat of reaction. Therefore the amount of material which can be charged solidly is limited. In an LD converter, up to about 30% of the total charge can be charged as cold scrap iron.

However, there are situations, particularly of an economic nature, which call for a higher cold scrap percentage, especially in the LD-steel process. A scrap iron preheating has been proposed, either in the converter or before charging. However, these known methodes to increase the use of cold scrap are unsatisfactory. The preheating in the converter itself reduces the output. In the preheating outside the converter, considerable heat losses by radiation must be accepted; in addition, the operation is made less efficient.

It has also been proposed that in converter operation, the blowing air be preheating by using the heat given off by the converter waste gases (German Pat. No. 824,791); however, the manner suggested, the preheating of the air in heat exchangers or heat storages receiving waste gas, is found economically impractical in view of the high load of dust and slag particles in the discharged waste gas.

It is therefore, an object of the present invention to preheat the oxygen, in an practical and economic manner. Instead of pure oxygen wind or oxygen enriched wind may be used too.

Another object of the present invention is to provide an heating arrangement of the foregoing character which may be readily maintained in service and which requires no unusual operator skill or operating procedures.

A further object of the present invention is to provide an arrangement, as described, which does not reduce the service life of the preheating installations.

SUMMARY OF THE INVENTION

The objects of the present invention are achieved by preheating the oxygen, namely the forced (blast) air or the forced (blast) oxygen, by means of steam.

As a rule, steam is available in ample quantities from steam generating plants in steel plants. For the present application, the steam, containing no dust load, proves to be an ideal heat carrier because the function of the heat transfer components in which the oxygen is preheated remains unimpaired. An advantage of steam as heat carrier is the available heat supply which is composed of the sensed heat of the steam and the heat of condensation of the steam. Preheating the oxygen in accordance with the present invention provides the economically attractive and practical utilization of the waste gas heat from the converter process itself. The waste gas chimneys of modern steel plants are being cooled, producing steam. This steam, which otherwise would escape, can be used to economic advantage in accordance with the invention.

In the majority of converters constituting a steel plant which are generally operated at different times (periodes) there is a connection between the steam ducts. In a further embodiment, there may be a connection to the steam lines of other steam generators of the plant.

The preheating in accordance with the present invention is virtually free of maintenance, requiring a relatively low investment. Because of the greater heat supply available by the preheating of the oxygen, this method permits an increase of the cold scrap percentage, with the tap weight remaining the same.

In case of bottlenecks in the pig iron supply, the method may be used for higher steel production by increasing the use of scrap in the steel plant and the pouring capacity.

Preferably, the heat transfer from steam to the oxygen proceeds via a heat exchanger which in the oxygen blast process is placed into the oxygen line leading to the converter.

The novel features which are considered as characteristic for the invention are set forth in particular in the appended claims. The invention itself, however, both as to its constructions and its method of operation, together with additional objects and advantages thereof, will be best understood from the following description of specific embodiments when read in connection with the accompanying drawings.

BRIEF DESCRIPTION OF THE DRAWING

A schematic view which shows an arrangement for heating an oxygen blast, in accordance with the present invention.

DESCRIPTION OF THE PREFERRED EMBODIMENTS

The apparatus of the present invention comprises a heat exchanger 11 which is placed into the oxygen duct 12 feeding the blast lance 13. Arrows A and B show the direction of flow of the heat carrier through the heat exchanger 11. The connecting duct 12' between that exchanger 11 and blast lance 13 is heat-insulated.

In a practical application, the duct 12 supplied 600 cubic meters/hr of oxygen at a pressure of 18 bars through the heat exchanger 11 to the blast lance 13. At the same time, the heat exchanger 11 received about 7 metric tons/hr of steam at 220° C. and 25 bars. The oxygen flowing through the heat exchanger 11 was preheated to about 210° C. This provided the possibility of increasing the scrap component by about 5%.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptions should and are intended to be comprehended within the meaning and range of equivalence of the following claims.

We claim:

1. A method for preheating the oxygen used in an oxygen steel making process, comprising the steps of: feeding oxygen from an oxygen storage bunker; directing said oxygen to a blast lance for blasting preheated oxygen on a steel bath; generating a supply of steam; applying said steam to said oxygen for preheating said gaseous oxygen by said steam before entering the lance to a temperature substantially between 200° C. and 300° C.; and recovering latent heat of vaporization of said steam by expanding the steam in a heat exchanger; said latent heat and sensible heat being used for preheating the oxygen; said latent heat and sensible heat being applied to the oxygen through heat conducting walls in the heat exchanger for preheating the oxygen, said walls separating the steam from the oxygen, said oxygen being predominantly preheated by said latent heat; and removing the steam from the heat exchanger after said latent heat has been recovered therefrom.

2. A method as defined in claim 1 wherein said steam is generated by waste gas produced in an converter process.

* * * * *